US007632166B2

(12) United States Patent
Chou et al.

(10) Patent No.: US 7,632,166 B2
(45) Date of Patent: Dec. 15, 2009

(54) METHOD FOR IMPROVING VACUUM

(75) Inventors: Lin-En Chou, Hsinchu (TW); Wei-Yi Lin, Hsinchu (TW); Cheng-Chung Lee, Hsinchu (TW); Ying-Hsien Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 704 days.

(21) Appl. No.: 11/362,812

(22) Filed: Feb. 28, 2006

(65) Prior Publication Data

US 2007/0060007 A1 Mar. 15, 2007

(30) Foreign Application Priority Data

Sep. 9, 2005 (TW) ..... 94131215 A

(51) Int. Cl.
*H01J 9/38* (2006.01)
*H01J 9/24* (2006.01)

(52) U.S. Cl. ..... 445/38; 445/24; 445/25

(58) Field of Classification Search ..... 445/24, 445/25, 38

See application file for complete search history.

(56) References Cited

U.S. PATENT DOCUMENTS

2002/0038558 A1 * 4/2002 Nakata et al. ..... 65/29.19

* cited by examiner

*Primary Examiner*—Nimeshkumar D. Patel
*Assistant Examiner*—Anne M Hines
(74) *Attorney, Agent, or Firm*—Stites & Harbison PLLC; Juan Carlos A. Marquez, Esq.

(57) ABSTRACT

A method for improving vacuum is applicable to a process of fabricating a vacuum display. The residual gas or lightwave heating material in the vacuum display is irradiated with at least one type of light source, such that the residual gas in the vacuum display acquires kinetic energy. Then, the residual gas is efficiently absorbed by a vacuum pump or at least one getter, and thereby the vacuum of the vacuum display is improved.

16 Claims, 10 Drawing Sheets

| oxygen types | absorbable light wave lengths (nm |
|---|---|
| (CO) | 4666 |
| ($CO_2$) | 7905. 7336. 7097 |
| ($H_2O$) | 10600. 6097. 2941 |
| (CH4) | 3428 |

FIG. 1

METHOD FOR IMPROVING VACUUM

CROSS-REFERENCE TO RELATED APPLICATIONS

This non-provisional application claims priority under 35 U.S.C. § 119(a) on Patent Application No. 094131215 filed in Taiwan, R.O.C. on Sep. 9, 2005, the entire contents of which are hereby incorporated by reference.

BACKGROUND OF THE INVENTION

1. Field of Invention

The present invention relates to a method for improving a vacuum, more particularly, to a method for achieving high vacuum of a vacuum display.

2. Related Art

The vacuum of an ordinary vacuum display may significantly affect the service lifetime and display quality of the vacuum display. For example, the interior of a Field Emission Display (FED) is a vacuum the same as a cathode ray tube (CRT), and the FED operates under a high vacuum state of $10^{-7}$ Torr to avoid electrons bumping against gas which may cause an effect similar to plasma or glitter and damage inner elements. Therefore, a pumping pipe is left in the FED having its upper and lower panels packaged, for vacuum pumping.

Use of the FED accomplishes the planarization of the CRT. The weight of the FED is less than a tenth that of the CRT, and the thickness of the FED is only a tenth that of the CRT. The power consumption of the FED is also lower than that of other types of display devices, and it eliminates the problem of view angle existing in the liquid crystal display (LCD). Therefore, the FED has enormous potential to meet demands for planarization, high luminance, and light weight.

The display method of the FED is similar to the operational principle of the CRT. That is, electrons are emitted from a cathode, pass through the vacuum, and are accelerated by an anode, thus bumping against the fluorescent material to emit lights. The fluorescent materials for both FED and CRT are the same, and the difference resides only in the way of generating electrons. In the CRT, the electrons are generated by heating the cathode tube, and are usually called hot cathode electrons, while in the FED, the electrons are drawn from the cathode with an electric field, and are usually called cold cathode electrons.

The internal circuit and carbon nano-tube in the FED have many holes for trapping gas molecules, i.e. reserving gas. When vacuum pumping, the whole FED is heated, such that the gas molecules acquire kinetic energy to dissociate from the surface, so as to purge gas adsorbed on the glass or other elements in the space, and exhaust the gas with a vacuum pump. After vacuum pumping, the pumping pipe is closed, sealed, and severed by heating with an oxyhydrogen flame gun, thus finishing packaging of the FED. After finishing packaging, there is still some residual gas in the FED and at this time the vacuum still cannot reach $10^{-7}$ Torr. Therefore, before packaging the upper and lower panels, a getter is placed therein, and after the pumping pipe is sealed, the getter is heated with high cycle waves to absorb the residual gas, such that the vacuum reaches $10^{-7}$ Torr.

However, for vacuum pumping, the FED usually is heated to above 300° C., such that the FED goes through another thermal cycle and thermal expansion and contraction. The inner elements and materials may be degraded when heating. And the glass panel may have a certain residual stress, and will be broken under a slight force. Therefore, both the product rate and service time of the FED are affected.

SUMMARY OF THE INVENTION

In the present invention, the residual gas or lightwave heating material in a vacuum display is irradiated with at least one type of light source, such that the residual gas in the vacuum display acquires kinetic energy, and then is absorbed by a vacuum pump or at least one getter efficiently, thereby improving the vacuum of the vacuum display.

In order to achieve the above object, the present invention provides a method for improving a vacuum, applicable to a vacuum display process. The method comprises irradiating a vacuum display with at least one type of light source such that the residual gas in the vacuum display acquires kinetic energy, pumping the vacuum display, and sealing the vacuum display, wherein the light source of a certain wavelength can be absorbed by the residual gas in the vacuum display.

The present invention further provides a method for improving a vacuum, applicable to a vacuum display process. The method comprises doping at least one lightwave heating material in the material surface layer of a vacuum display; irradiating the lightwave heating material with at least one type of light source for heating the lightwave heating material, such that the residual gas in the vacuum display acquires kinetic energy through the heat energy generated by heating the lightwave heating material, and pumping the vacuum display; and sealing the vacuum display, wherein the light source of a certain wavelength can be absorbed by the lightwave heating material in the vacuum display.

The present invention further provides a method for improving vacuum, applicable to a vacuum display. The method comprises disposing at least one getter in a vacuum display; pumping the vacuum display and sealing it, such that the vacuum display stays in a vacuum state; and irradiating the vacuum display with at least one light source, such that the residual gas in the vacuum display acquires kinetic energy, and thus can be absorbed by the getter efficiently, wherein the light source of a certain wavelength can be absorbed by the residual gas in the vacuum display.

Finally, the present invention further provides a method for improving vacuum, applicable to a vacuum display. The method comprises doping at least one lightwave heating material in the material surface layer of a vacuum display; disposing at least one getter in the vacuum display; pumping the vacuum display and sealing it, such that the vacuum display stays in a vacuum state; and irradiating the lightwave heating material with at least one type of light source to heat the lightwave heating material, such that the residual gas in the vacuum display acquires kinetic energy through the heat energy generated by heating the lightwave heating material, and thus can be absorbed by the getter efficiently, wherein the light source of a certain wavelength can be absorbed by the lightwave heating material in the vacuum display.

With the implementation of the present invention, at least the following progress can be achieved.

1. The electrons can be prevented from bumping against the gas which may cause an effect similar to plasma or glitter, and damage the inner elements of the vacuum display, thereby the service time of the display can be prolonged.

2. The high vacuum can be achieved without heating the whole vacuum display, and thus the inner elements and materials of the vacuum display can be prevented from being degraded due to heating, thereby reducing the residual stress and enhancing the product yield.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only for, and which thus is not limitative of the present invention, and wherein:

FIG. 1 shows a comparison table for gas molecules corresponding to the one set of wavelength with which the light can be absorbed in the infrared (IR) range;

DETAILED DESCRIPTION OF THE INVENTION

Figure 2:
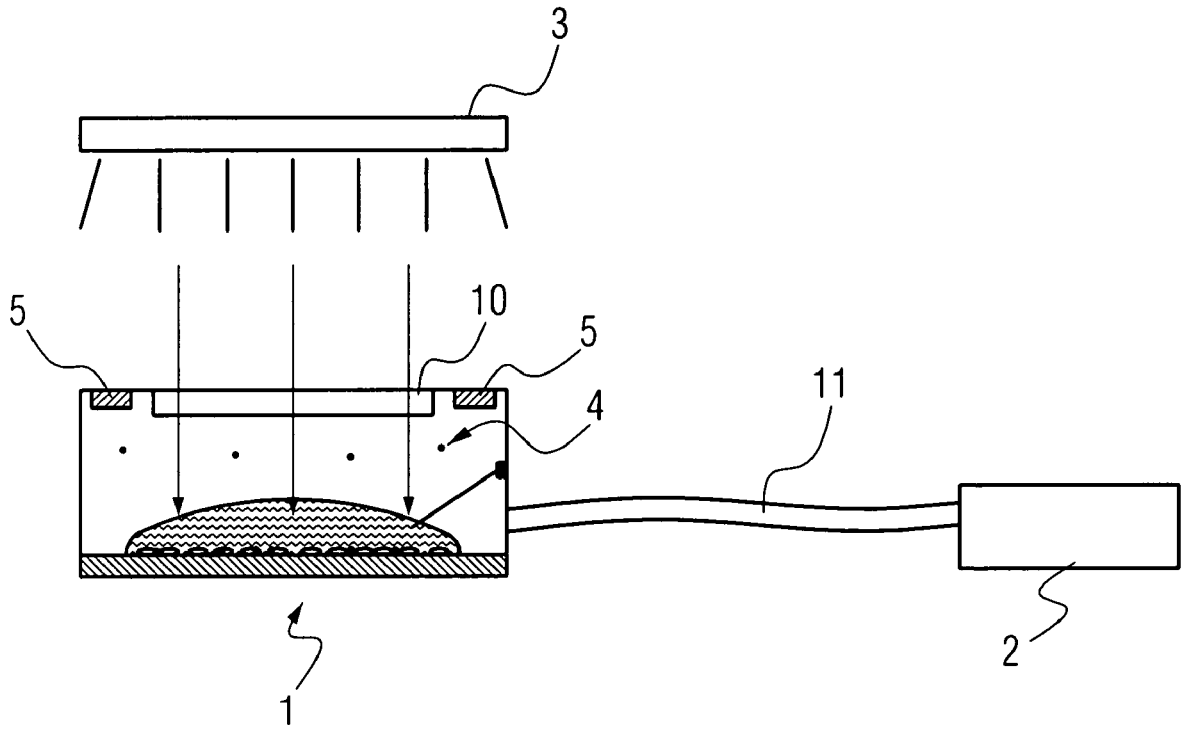
FIG. 2 shows a vacuum pump used in accompany with a light source irradiating residual gas molecules in the vacuum display according to an embodiment of the present invention.

In order to make the objects, structural features, and functions of the present invention apparent, the related embodiments accompanied with drawings are described in detail.

In FIG. 1, a comparison table for gas molecules corresponding to the one set of wavelength with which the light can be absorbed in the infrared (IR) range is shown. Light of a wavelength of 4666(nm) can be absorbed by CO, light of wavelengths of 7905, 7336, 7097 (nm) can be absorbed by $CO_2$, and the like, and the rest may be deduced by analogy, and is not limited to the table.

The present invention utilizes the property that each kind of the gas molecules 4 absorbs the light of a certain wavelength. When a light source 3 emits a light of a wavelength which can be absorbed by the gas molecules 4 to be purged, it irradiates the gas molecules 4 or the lightwave heating material in a vacuum display 1, such that the light can be absorbed by the gas molecules 4, and thus the gas molecules 4 acquires enough kinetic energy to escape from holes of the material or the surface of the material on which the molecules are adsorbed. The gas molecules 4 are exhausted by a vacuum pump 2 or absorbed by a getter 5, thereby achieving a high vacuum of the vacuum display 1.

First Embodiment

In FIG. 2, it shows a vacuum pump used in accompany with a light source irradiating residual gas molecules in the vacuum display according to an embodiment of the present invention. The vacuum display 1 in the present embodiment is a FED. After the upper and lower panels of the vacuum display are packaged, the vacuum display 1 and a vacuum pump 2 are connected with a pumping pipe 11, and the vacuum pump 2 pumps the vacuum display 1.

Figure 3:
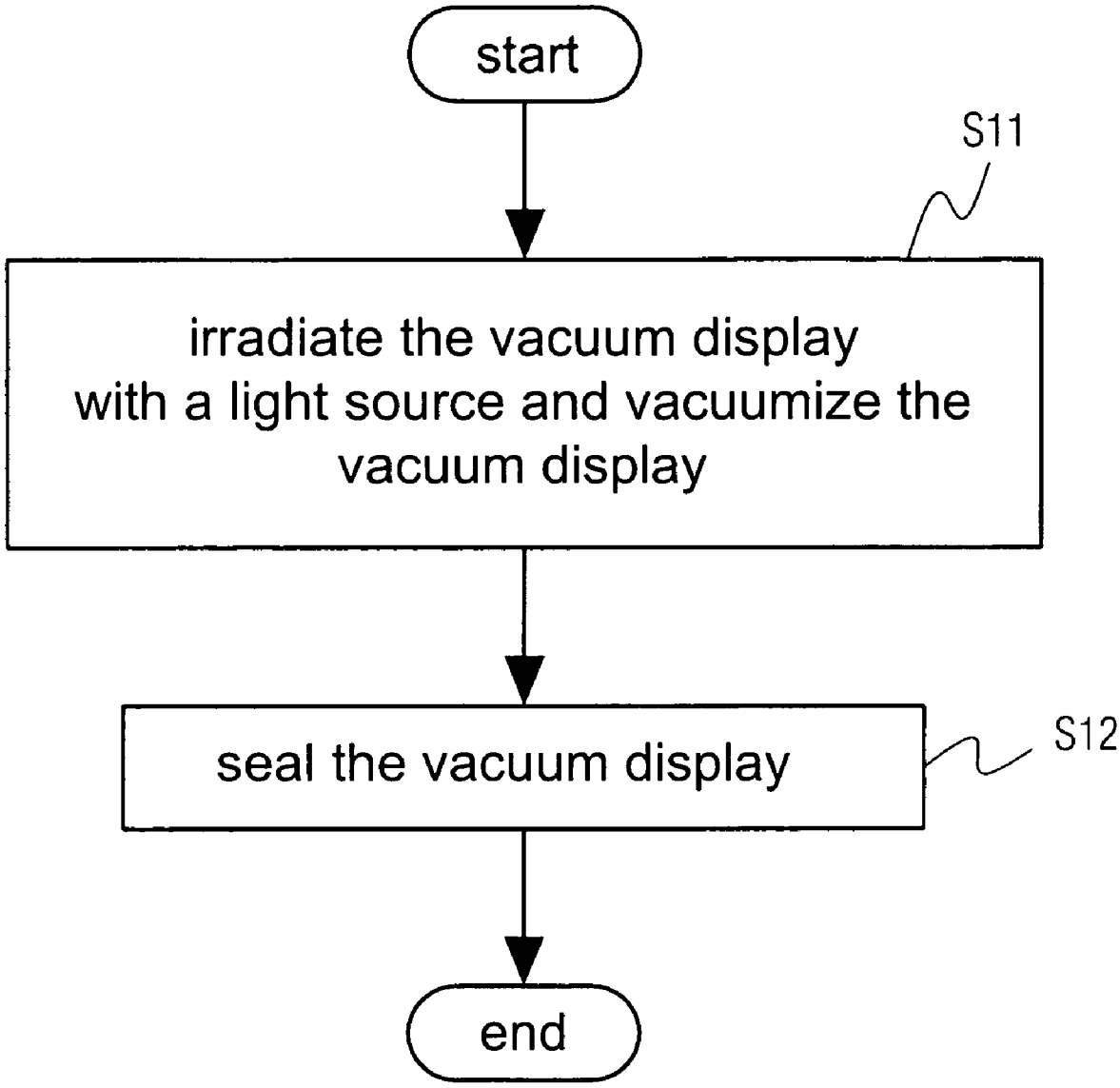
FIG. 3 shows a flow chart of a first embodiment of the present invention.

In FIG. 3, it is a flow chart of a first embodiment of the present invention. In order to make the residual gas molecules 4 in the vacuum display 1 exhausted by the vacuum pump 2 or absorbed by the getter 5 efficiently, the present embodiment provides a method for improving vacuum, which comprising first irradiating the vacuum display 1 with at least one light source 3 before or during pumping, and pumping the vacuum display 1 with the vacuum pump 2, wherein the light source 3 of a certain wavelength can be absorbed by the residual gas molecules 4 in the vacuum display 1. Therefore, the residual gas molecules 4 absorb the energy of the lightwave and acquire enough kinetic energy to escape from the holes of the material or the surface of the material on which the molecules are adsorbed. Then the residual gas molecules 4 are exhausted by the vacuum pump 2 via the pumping pipe 11, thereby achieving a high vacuum of the vacuum display 1 (step S11 ). Then, the vacuum display 1 is sealed (step S12).

Further, in order to keep a favorable vacuum of the vacuum display 1 after finishing pumping and sealing, at least one getter 5 are further disposed in the vacuum display 1 without shielding a display area 10 before packaging the upper and lower panels of the vacuum display. After sealing the vacuum display 1 (step S12), the residual gas molecules 4 in the vacuum display 1 can be further adsorbed by the getter 5, such that the vacuum display 1 can maintain a high quality of vacuum.

Second Embodiment

Figure 4:
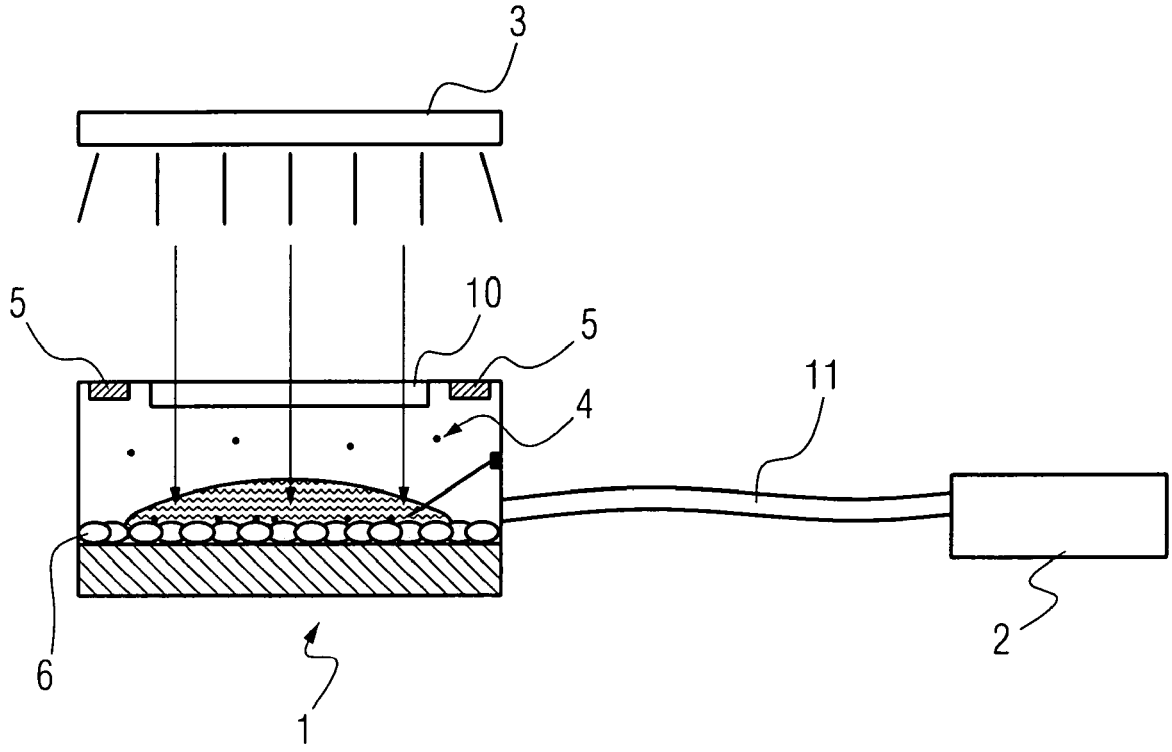
FIG. 4 shows a vacuum pump used in accompany with a light source irradiating the lightwave heating material in the vacuum display according to an embodiment of the present invention.
Figure 5:
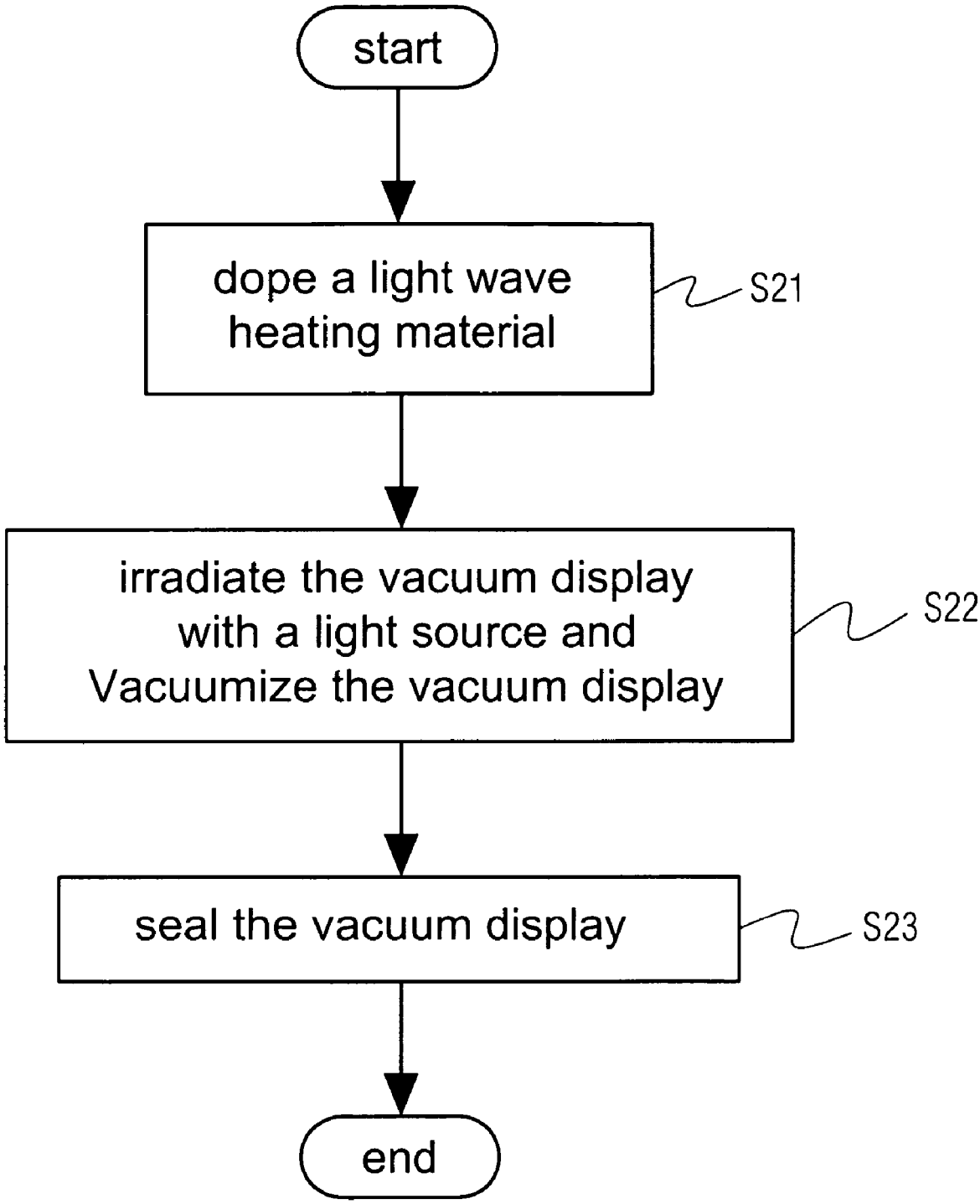
FIG. 5 shows a flow chart of a second embodiment of the present invention.

FIG. 4 shows a vacuum pump used in accompany with a light source irradiating the lightwave heating material in the vacuum display according to an embodiment of the present invention. And FIG. 5 shows a flow chart of a second embodiment of the present invention. The vacuum display 1 of the present embodiment is an FED, and is also connected to a vacuum pump 2 via a pumping pipe 11. However, when fabricating the vacuum display 1, at least one type of lightwave heating material 6 is first added in the material surface layer in the vacuum display 1. Specifically, the lightwave heating material 6 is mixed with the material for manufacturing the parts of the vacuum display 1 first and then the parts are fabricated. Or the lightwave heating material 6 is coated on the surface of the fabricated parts.

The method for improving vacuum according to the second embodiment of the present invention comprises first doping at least one lightwave heating material 6 in the material surface layer of the vacuum display 1 (step S21); irradiating the lightwave heating material 6 with at least one type of light source 3 for heating it, wherein the light source 3 of a certain wavelength can be absorbed by the lightwave heating material 6. With the heat energy generated by heating the lightwave heating material 6, the residual gas molecules 4 in the vacuum display 1 acquire kinetic energy and thus can escape from the holes of the material or the surface of the material on which the molecules are adsorbed. The vacuum display 1 is pumped by the vacuum pump 2 via the pumping pipe 11, such that the vacuum display 1 reaches a high vacuum state (step S22). And the pumping pipe 11 is removed and the pumping hole of the vacuum display 1 is sealed (step S23).

Before packaging the upper and lower panels of the vacuum display, at least one getter 5 is disposed in the vacuum display 1 without shielding a display area 10. The getter 5 is disposed before packaging the upper and lower panels of the vacuum display 1. After the vacuum display 1 is sealed in step S23, the residual gas molecules 4 left in the vacuum display 1 is absorbed by the getter 5.

In the present embodiment, light sources 3 with different wavelengths are selected depending on different lightwave heating materials. And the lightwave heating material 6 can be a photocatalyst material or a microwave heating material. Also, the photocatalyst material can be $TiO_2$ or ZnO, and the microwave heating material can be a Ba compound.

Third Embodiment

Figure 6:
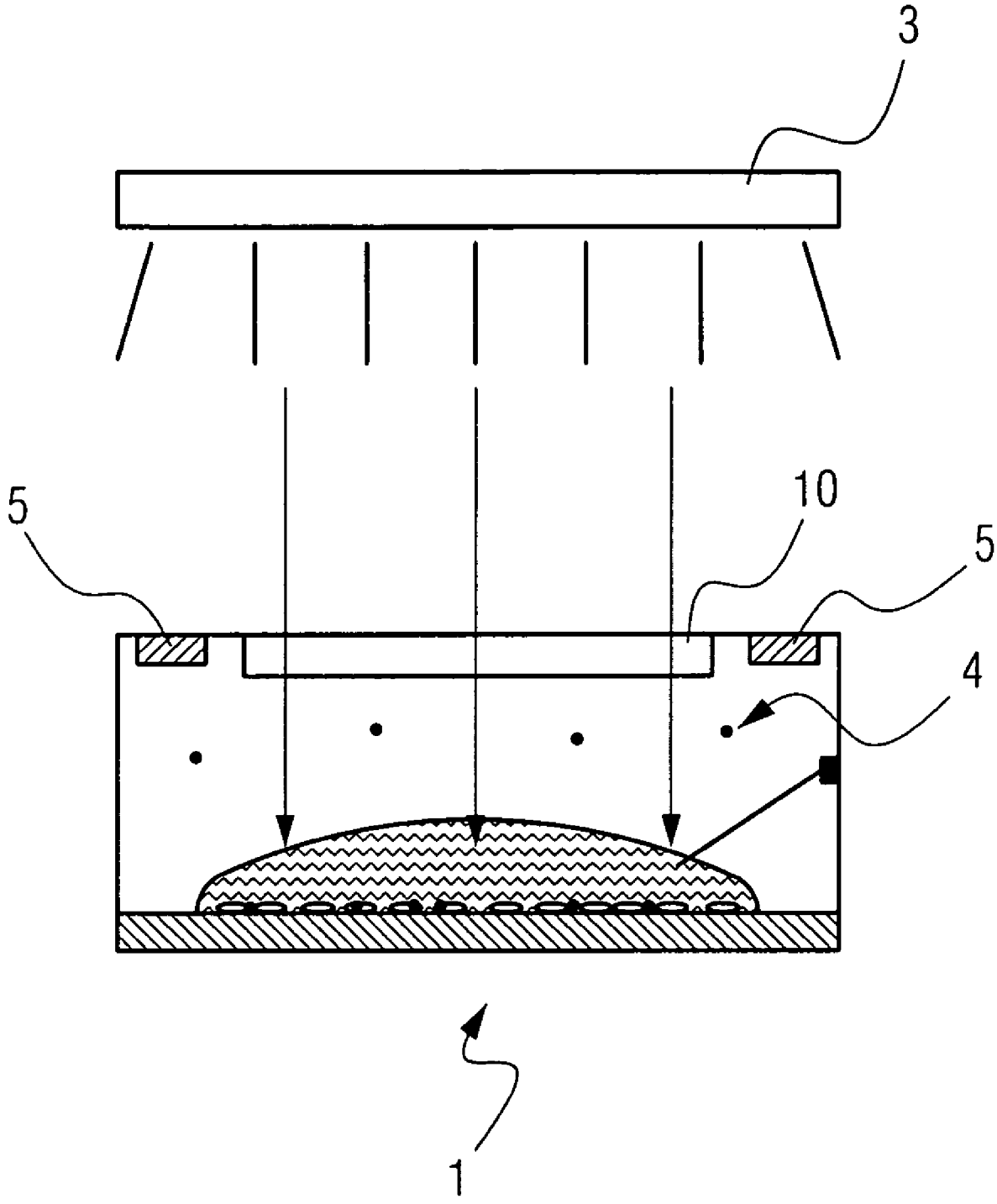
FIG. 6 shows a getter used in accompany with a light source irradiating residual gas molecules in the vacuum display according to an embodiment of the present invention.
Figure 7:
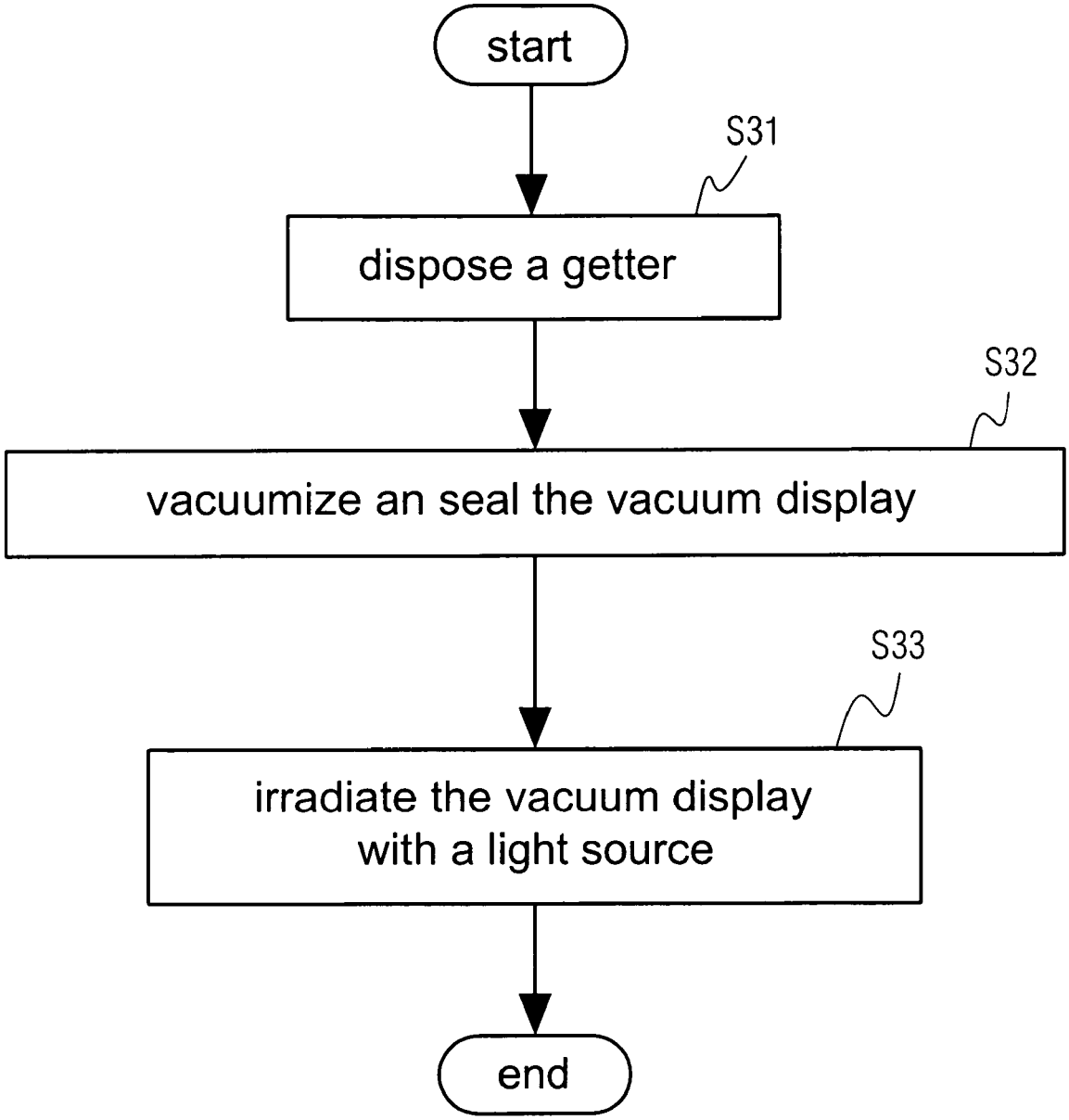
FIG. 7 shows a flow chart of a third embodiment of the present invention.

FIG. 6 shows a getter used in accompany with a light source irradiating residual gas molecules in the vacuum display according to an embodiment of the present invention. And FIG. 7 shows a flow chart of a third embodiment of the present invention. The vacuum display 1 of the present embodiment is an FED. And the method for improving vacuum according to the third embodiment of the present invention comprises disposing at least one getter 5 in the vacuum display 1 without shielding a display area 10 before packaging the upper and lower panels of the vacuum display 1 (step S31); pumping the vacuum display 1 by a vacuum pump 2 via a pumping pipe 11 and sealing it, such that the vacuum display 1 stays in a vacuum state (step S32); and irradiating the vacuum display 1 with at least one type of light source 3, wherein the light source 3 of a certain wavelength can be absorbed by the residual gas molecules 4 in the vacuum display 1, and thus the residual gas molecules 4 in the vacuum display 1 can acquire enough kinetic energy to escape from the holes of the material or the surface of the material on which they are adsorbed. Therefore, the residual gas molecules 4 can be absorbed by the getter 5 efficiently, thereby achieving a high vacuum (step S33).

Fourth Embodiment

Figure 8:
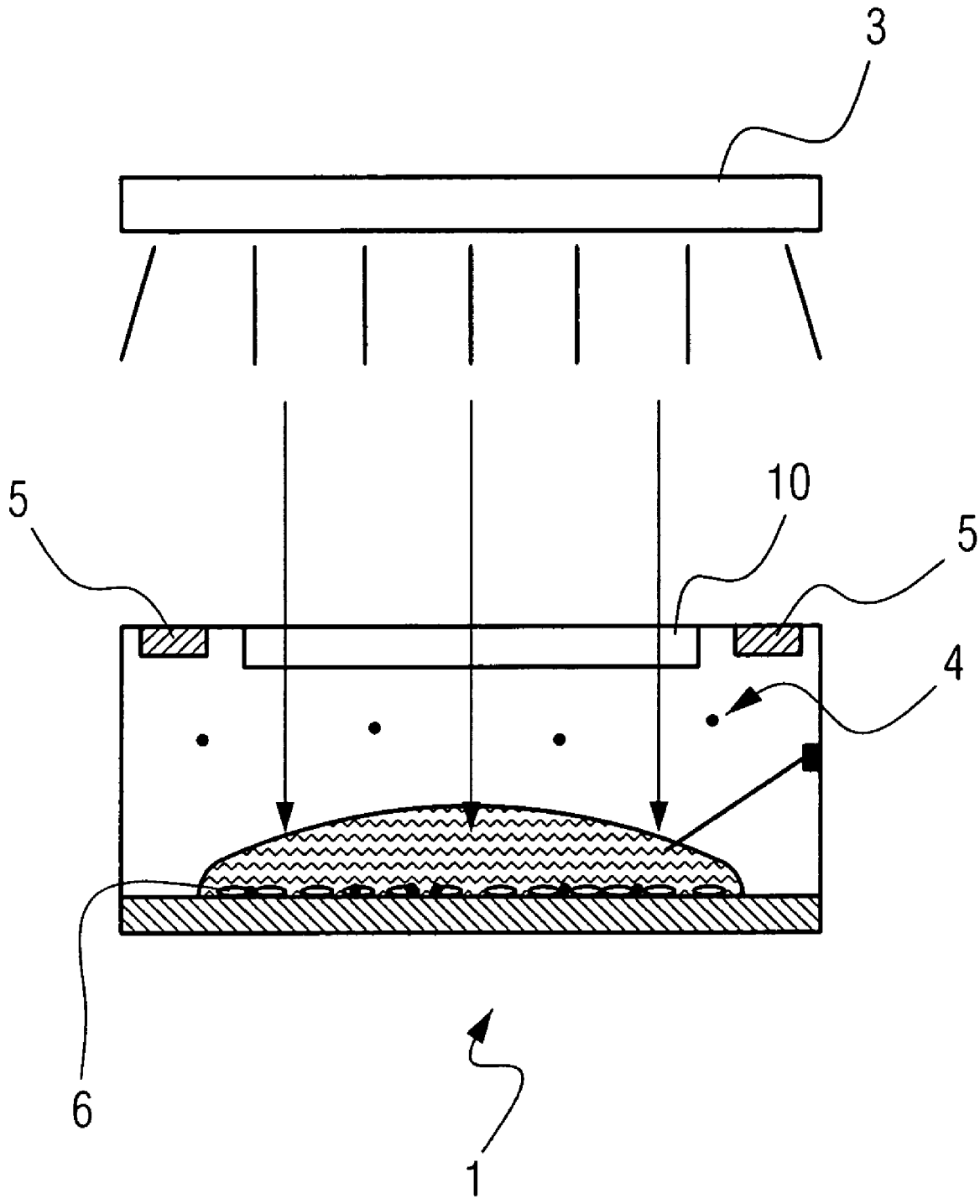
FIG. 8 shows a getter used in accompany with a light source irradiating the lightwave heating material according to an embodiment of the present invention.
Figure 9:
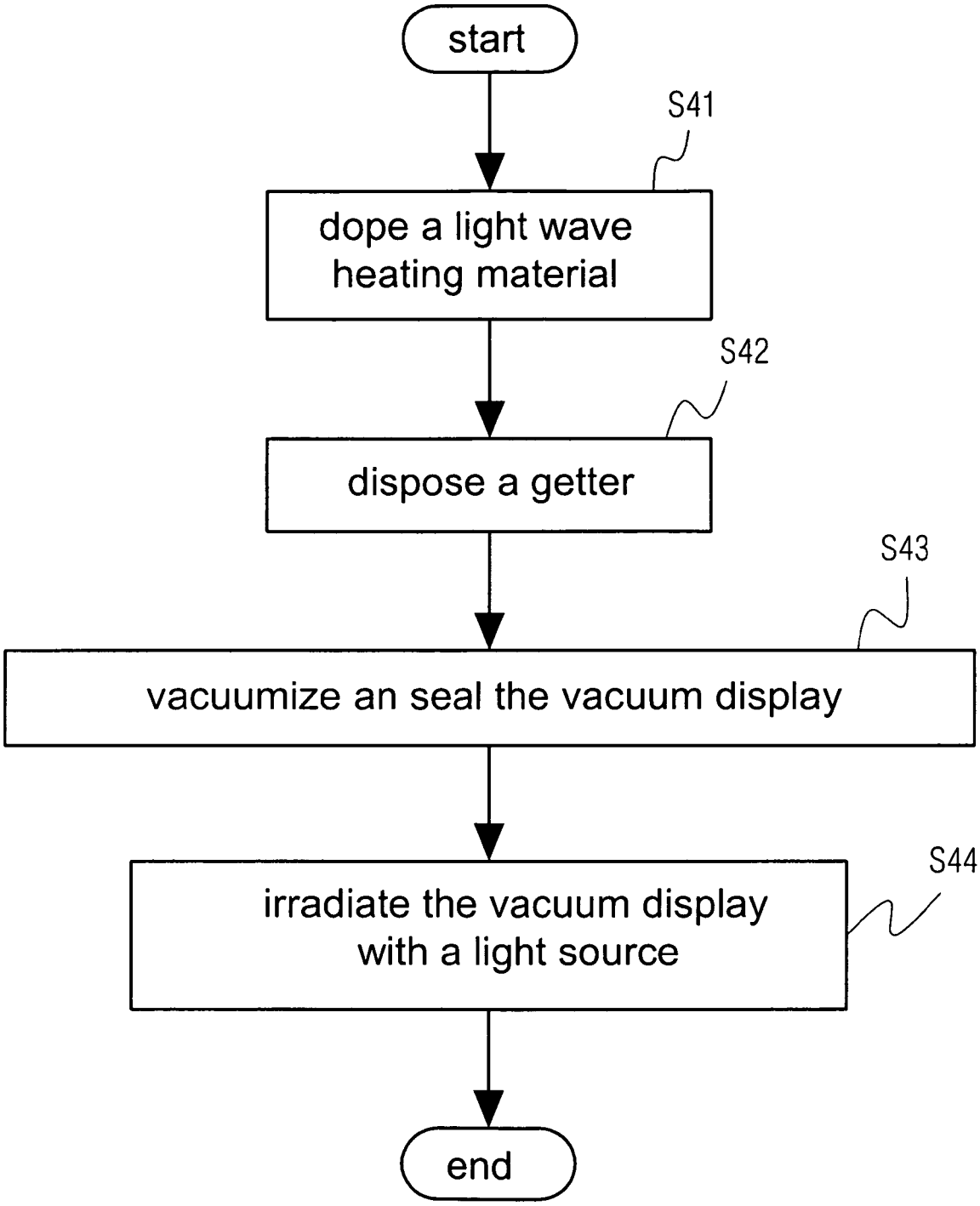
FIG. 9 shows a flow chart of a fourth embodiment of the present invention.

FIG. 8 shows a getter used in accompany with a light source irradiating the lightwave heating material according to an embodiment of the present invention. And FIG. 9 shows a flow chart of a fourth embodiment of the present invention. The vacuum display 1 of the present embodiment is an FED. The method for improving vacuum according to the fourth embodiment of the present invention comprises doping at least one lightwave heating material 6 in the material surface layer of a vacuum display 1, i.e. mixing the lightwave heating material 6 and the materials for fabricating the parts of the vacuum display 1 and then manufacturing the parts, or coating the lightwave heating material 6 on the surface of the fabricated parts (step S41); disposing at least one getter 5 in the vacuum display 1 without shielding the display area 10 before packaging the vacuum display 1 (step S42); pumping the vacuum display 1 by the vacuum pump 2 via the pumping pipe 11, and removing the pumping pipe 11 and sealing the pumping hole after finishing pumping, such that the vacuum display 1 stays in a vacuum state (step S43); and irradiating the lightwave heating material 6 with at least one type of light source 3, wherein the light source 3 of a certain wavelength can be absorbed by the lightwave heating material 6, and thus the residual gas molecules 4 in the vacuum display 1 acquire enough kinetic energy through the heat energy generated by heating the lightwave heating material 6, so as to escape from the holes of the material or the surface of the material on which they are adsorbed. Therefore, the residual gas molecules 4 can be efficiently absorbed by the getter 5 (step S44).

In the present embodiment, different light sources 3 with different wavelengths are selected depending on different lightwave heating materials. The lightwave heating material 6 can be a photocatalyst material or a microwave heating material, wherein the photocatalyst material can be a $TiO_2$ or a ZnO, and the microwave heating material can be a Ba compound.

Figure 10:
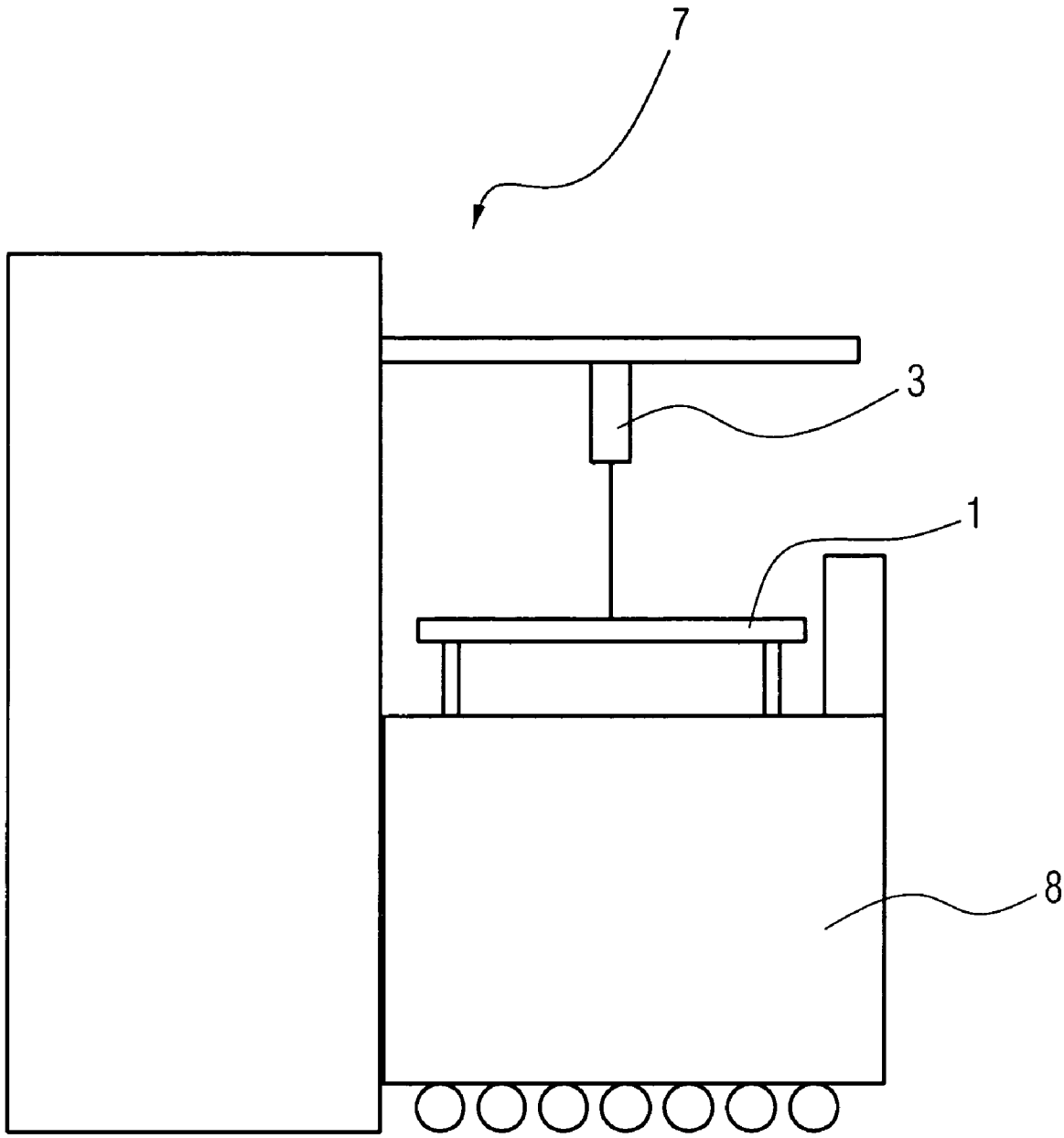
FIG. 10 shows a pumping system used in accompany with a light source irradiating the vacuum display during fabrication according to an embodiment of the present invention.

In addition to the above embodiments, in FIG. 10, a pumping system used in accompany with a light source irradiating the vacuum display during fabrication according to an embodiment of the present invention is shown. In order to enhance the product efficiency during mass production, a generator for generating at least one light source 3 is added to the conventional pumping system 7, and the vacuum display 1 is disposed on the pumping car 8. After a statistical analysis of the sorts and positions of the residual gas molecules for a vacuum display, a particular light source 3 is used to irradiate a certain area. Also, the light source 3 is implemented as a dot light source, line light source, surface light source, dot light source scanning, or line light source scanning, or the like, to optimize the product efficiency.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for improving a vacuum applicable to a vacuum display process, comprising:

after a upper panel and a lower panel of a vacuum display are packaged, irradiating a vacuum display with at least one type of light source, such that the residual gas in the vacuum display acquires kinetic energy, and pumping the vacuum display; and sealing the vacuum display, wherein the light source of a certain wavelength is absorbed by the residual gas in the vacuum display.

2. The method for improving a vacuum as claimed in claim 1, wherein the vacuum display is a Field Emission Display (FED).

3. The method for improving a vacuum as claimed in claim 1, wherein at least one getter is further disposed inside the vacuum display.

4. A method for improving a vacuum applicable to a vacuum display process, comprising:

doping at least one lightwave heating material in the material surface layer of a vacuum display;

irradiating the lightwave heating material with at least one type of light source to heat the lightwave heating material, such that the residual gas in the vacuum display acquires kinetic energy through the heat energy generated by heating the lightwave heating material, and pumping the vacuum display; and sealing the vacuum display, wherein the light source of a certain wavelength is absorbed by the lightwave heating material in the vacuum display.

5. The method for improving a vacuum as claimed in claim 4, wherein the vacuum display is an FED.

6. The method for improving a vacuum as claimed in claim 4, wherein at least one getter is further disposed inside the vacuum display.

7. The method for improving a vacuum as claimed in claim 4, wherein the lightwave heating material is a photocatalyst material or a microwave heating material.

8. The method for improving a vacuum as claimed in claim 7, wherein the photocatalyst material is a $TiO_2$ or a ZnO.

9. The method for improving vacuum as claimed in claim 7, wherein the microwave heating material is a Ba compound.

10. A method for improving a vacuum applicable to a vacuum display, comprising:

disposing at least one getter in a vacuum display;

pumping the vacuum display and sealing it, such that the vacuum display stays in a vacuum state; and irradiating the sealed vacuum display with at least one light source, such that the residual gas in the vacuum display acquires kinetic energy, thus the residual gas is absorbed by the getter efficiently, wherein the light source of a certain wavelength is absorbed by the residual gas in the vacuum display.

11. The method for improving a vacuum as claimed in claim 10, wherein the vacuum display is an FED.

12. A method for improving a vacuum applicable to a vacuum display, comprising:

doping at least one lightwave heating material in the material surface layer of a vacuum display;

disposing at least one getter in the vacuum display;

pumping the vacuum display and sealing it, such that the vacuum display stays in a vacuum state; and irradiating the lightwave heating material with at least one type of light source to heat the lightwave heating material, such that the residual gas in the vacuum display acquires kinetic energy through the heat energy generated by heating the lightwave heating material, thus the residual gas is absorbed by the getter efficiently, wherein the light source of a certain wavelength is absorbed by the lightwave heating material in the vacuum display.

13. The method for improving a vacuum as claimed in claim 12, wherein the vacuum display is an FED.

14. The method for improving a vacuum as claimed in claim 12, wherein the lightwave heating material is a photocatalyst material or a microwave heating material.

15. The method for improving a vacuum as claimed in claim 14, wherein the photocatalyst material is a $TiO_2$ or a ZnO.

16. The method for improving a vacuum as claimed in claim 14, wherein the microwave heating material is a Ba compound.

* * * * *

UNITED STATES PATENT AND TRADEMARK OFFICE

CERTIFICATE OF CORRECTION

PATENT NO. : 7,632,166 B2
APPLICATION NO. : 11/362812
DATED : December 15, 2009
INVENTOR(S) : Chou et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 962 days.

Signed and Sealed this

Second Day of November, 2010

David J. Kappos

David J. Kappos
*Director of the United States Patent and Trademark Office*